United States Patent [19]

Clark

[11] Patent Number: 4,556,853

[45] Date of Patent: Dec. 3, 1985

[54] MODE-CONTROLLING WAVEGUIDE-TO-COAX TRANSITION FOR TV BROADCAST SYSTEM

[75] Inventor: Raymond N. Clark, Cherry Hill, N.J.

[73] Assignee: RCA Corporation, Princeton, N.J.

[21] Appl. No.: 655,529

[22] Filed: Sep. 28, 1984

[51] Int. Cl.[4] ..... H01P 5/103

[52] U.S. Cl. ..... 333/26; 333/33

[58] Field of Search ..... 333/21 R, 26, 33

[56] References Cited

U.S. PATENT DOCUMENTS 2,619,539 11/1952 Fano .
2,878,453 3/1959 Elliott .
3,182,272 5/1965 Borghetti .
3,205,498 9/1965 Child ..... 333/21 R X
4,129,871 12/1978 Johns .

OTHER PUBLICATIONS

Microwave Antenna Theory and Design, edited by S. Silver, published by Dover Publications, 1965, p. 8.

*Primary Examiner*—Paul Gensler

*Attorney, Agent, or Firm*—Eugene M. Whitacre; Peter M. Emanuel; William H. Meise

[57] ABSTRACT

A coax-fed slotted-cylinder (pylon) antenna for UHF television operation at power of 200 kW and above has a coaxial feed which is large enough to propagate higher $TE_{11}$ mode as well as the desired fundamental TEM mode. The power fed to each slot and as a consequence the antenna array factor may be perturbed by the higher modes. It is important to reduce losses in the feed of the high-power signals from the transmitter or high power amplifier up the tower to the antenna. For lowest loss, a waveguide is used for the run up the tower. A waveguide-to-coax transition is used for adapting the waveguide to the coaxial antenna feed while suppressing the undesired $TE_{1,1}$ mode. The transition has two short semicircular waveguides opening into the waveguide feed from the transmitter. The semicircular walls of the two waveguides are coupled to the outer conductor of the coax antenna feed. The semicircular waveguides have a common flat wall, the center of one core of which is coupled to the center-conductor of the coax antenna feed.

6 Claims, 11 Drawing Figures

MODE-CONTROLLING WAVEGUIDE-TO-COAX TRANSITION FOR TV BROADCAST SYSTEM

BACKGROUND OF THE INVENTION

A mode-suppressing waveguide-to-coax transition which is useful for feeding a high powered pylon (slotted-cylinder) broadcast antenna.

Terrestial television broadcasters derive their incomes by revenues associated with the broadcasting of television signals to television receivers within a certain region. Each broadcaster in order to maximize his income attempts to reach the maximum possible number of viewers. For each television broadcasting site, there is a maximum permissible transmitted power, which depends upon the frequency of operation. At VHF frequencies, the current maximum permissible power is less than 100 killowatts (kw) while at UHF frequencies (470–830 MHz) the maximum permissible peak-of-sync power is in excess of 200 kw. The maximum power is used when viewers at substantial distances from the broadcasting site are to be reached. In order to benefit from transmitter power near the maximum allowable power, the broadcast antenna should be placed at the highest possible location, as for example atop a hill or tower (otherwise the signal energy at nearby viewers exceeds the minimum necessary for good reception, and the excess power is wasted). Such towers may be up to 2,000 feet in height in order to give the best line-of-sight to the distant viewers. In order to efficiently direct the radiated power towards the most distant viewers, high-power television broadcast arrangements ordinarily use a high-gain antenna, which concentrates most of the energy into a solid angle only a few degrees in height, generally centered on the horizon. Such high-gain antennas require a large vertical aperture in order to achieve the high gain necessary to so concentrate the energy. The large vertical aperture requires a structure having a vertical dimension or height of as much as 32 wavelengths. Since a wavelength at lower UHF frequencies is more than two feet, it can be seen that the vertical height of a high-gain UHF antenna may exceed 60 feet.

The environmental conditions at the antenna location are very severe. The antenna may be subjected to lightning, severe winds due to the high and unobstructed location atop the tower, and icing. These environmental conditions place severe mechanical restrictions on the antenna. The high winds, especially in the presence of an ice load, create an upsetting force or moment which tends to twist the antenna from the top of the tower. The magnitude of the forces increases as the square of the distance which the antenna projects from the support. If guy wires could be used to support the top of the antenna against the lateral component of the forces due to wind loading, the mechanical requirements would be eased. However, due to the omnidirectional nature of the radiation desired from the antenna in ordinary applications, the perturbing presence of guy wires is not acceptable. Consequently, the antenna is supported in cantilevered fashion from the top of the tower. In order to minimize the magnitude of the forces which must be resisted in a cantilevered fashion near the base of the antenna, the wind loading of the antenna must be reduced as much as possible. A very popular type of UHF antenna having low wind loading and a sturdy structure is the slotted-cylinder or pylon antenna (also known as a beacon antenna) which includes an elongated vertical transmission line having a conductive outer surface into which radiating slots are cut. The energy passing through the transmission line is coupled to the slots in a controlled fashion to produce the desired antenna array factor, and any energy continuing past the last slot is either dissipated in a resistive load or controllably reflected for radiation by the slots. The transmission-line may be either waveguide or coaxial (coax). A circular waveguide has lower loss than a coaxial transmission line, but has a larger diameter. The smaller diameter of the coax gives reduced wind loading, and the pylon antenna generally uses a coaxial transmission-line feed.

As mentioned, the antenna location is at the top of a tower which may be as much as 2,000 feet tall. The transmitter or power amplifier which produces the television signal energy is a large structure which is located on the ground. The signal energy must be transmitted from the transmitter, up the tower to the feed point at the base of the antenna. As mentioned, waveguide has lower loss than coax. Because of the great length of the run from the transmitter to the base or feed of the antenna, it is very desirable to use waveguide. This becomes apparent when considering that a difference of only 0.1 dB in transmission loss represents about 7000 watts difference in loss (for an input power of 200 kw). The larger dimensions of the waveguide are not a crucial consideration for the run up the tower, because the lateral forces due to wind loading on the tower and on the waveguide may be resisted by guy wires attached to the top of the tower (the base of the antenna). A waveguide-to-coaxial-transmission-line adapter (waveguide-to-coax-adapter) is required between the output of the waveguide and the coaxial feed of the antenna.

The power handling capability of a coaxial transmission line depends upon its dimensions. For a given impedance level, as for example 50 ohms, the higher the power being carried, the higher the voltage between the inner and outer conductors and the larger the current flow in the center and outer conductors. High power operation therefore requires large inner-to-outer conductor spacing to prevent voltage breakdown and large cross-sectional dimension of the inner conductor to reduce $I^2R$ losses. It has been found that for UHF power levels in the vicinity of 200 kw that reliable operation of the coax requires an outer conductor diameter of 10 to 12 inches. At such diameters, a coaxial transmission line supports not only the dominant TEM mode propagation but will also support $TE_{1,1}$ mode propagation at the frequency of operation. Propagation of the $TE_{1,1}$ mode is undesirable because of the possibility of affecting the amount of power coupled into the various radiating slots and thereby affecting the aperture distribution of the antenna. This can result because the slots are fed with two modes TEM and $TE_{1,1}$, one of which is not controlled. FIG. 8*a* illustrates the TEM mode, and FIG. 8*b* illustrates the $TE_{1,1}$ mode. Higher-order modes which can be propagated in coax are illustrated in FIGS. 8*c–d*.

The undesirable $TE_{1,1}$ mode may be suppressed by using for the waveguide-to-coax transition the apparatus described in U.S. Pat. No. 2,878,453 issued Mar. 17, 1959 to Elliott. The Elliott arrangement includes a rectangular waveguide which gradually splits, and the resulting split waveguides twist in opposite directions until they are recombined to form a coax in a manner which produces TEM mode propagation in the coax while supressing $TE_{1,1}$ mode operation. However, the Elliott transition is physically large and very difficult to fabricate, especially in view of the required longitudinal twist to the rectangular waveguide and because of the large size of the waveguide at lower than UHF frequencies. Another waveguide-to-coax transition is described in U.S. Pat. No. 2,619,539 issued Nov. 25, 1952 to Fano. The Fano arrangement includes a coaxial line which intersects the broad wall of a rectangular waveguide, with the center-conductor passing through the waveguide to the opposite wall of the waveguide. A conductive plate lying parallel to an axis of symmetry of the waveguide connects the center and outer conductors inside the coax. The bandwidth of this structure is narrow because the waveguide is in effect short-circuited by the conductive plate and the center conductor of the coax. The narrow bandwidth is undesirable for use over a television channel, where the bandwidth is 6 MHz.

Thus, high-power television broadcasting arrangement is desired in which the antenna is coaxially fed and in which a run of waveguide couples the high signal power to the coax with suppressed $TE_{1,1}$ mode.

SUMMARY OF THE INVENTION

A waveguide-to-coax adapter includes a coaxial tranmission-line intersecting the broad wall of a rectangular waveguide with the center-conductor terminating outside the waveguide. A flat conductive plate lying in a plane parallel with a plane of symmetry of the rectangular waveguide divides the outer conductor into two parallel semicircular waveguides at a location adjacent the intersection of the coaxial line and the waveguide.

DESCRIPTION OF THE INVENTION

Figure 1:
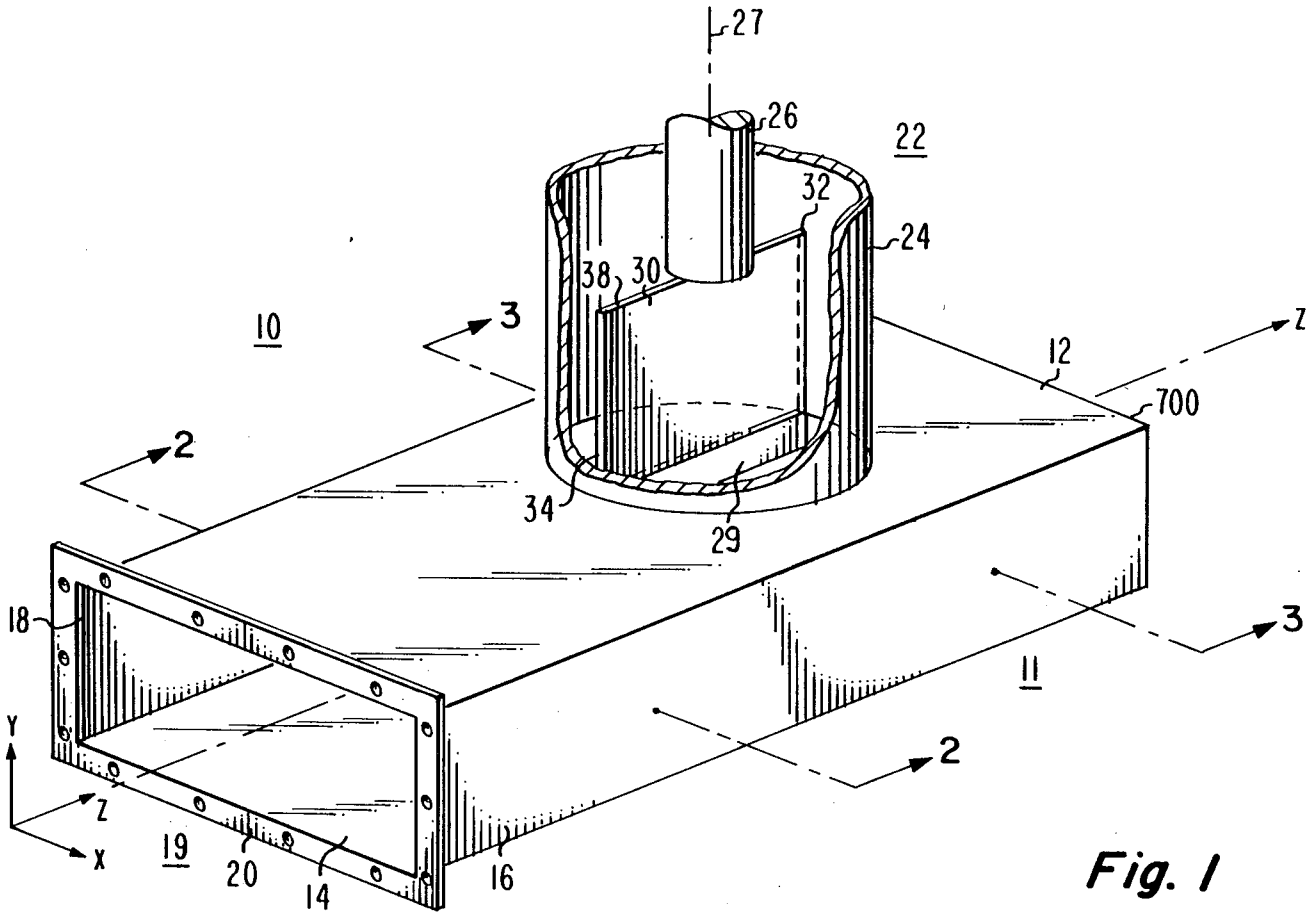
FIG. 1 is a partially cut-away perspective view of a waveguide-to-coaxial-line adapter according to an embodiment of the invention.

In FIG. 1, a rectangular waveguide-to-coaxial transmission-line (waveguide-to-coax) transition or adapter 10 includes a section of rectangular waveguide 11 including first and second broad conductive walls 12 and 14 spaced apart by narrow conductive walls 16 and 18. The waveguide is arranged for energy propagation in the Z direction, and has a first plane of symmetry illustrated as the Y-Z plane which bisects the broad walls and a second plane of symmetry X-Z bisecting the narrow walls. A bolt flange 20 is coupled to an entrance port 19 of the rectangular waveguide as known to allow coupling to the waveguide. A portion of coaxial transmission-line designated generally as 22 and including a conductive cylindrical outer conductor 24 and a cylindrical center or inner conductor 26 coaxial with a central axis 27 intersects broad wall 12 at a circular aperture 29 centered on axis 27. Outer-conductor 24 is shown partially cut-away to show a conductive plate 30 lying in the Y-Z plane of symmetry and diametrically oriented within outer conductor 24. Plate 30 is connected to center conductor 26 at an edge 38 remote from aperture 29, and is also connected to outer conductor 24 along edges 32 and 34. The lower edge of plate 30 terminates at the plane of aperture 29 and does not extend across the waveguide to wall 14.

Figure 2:
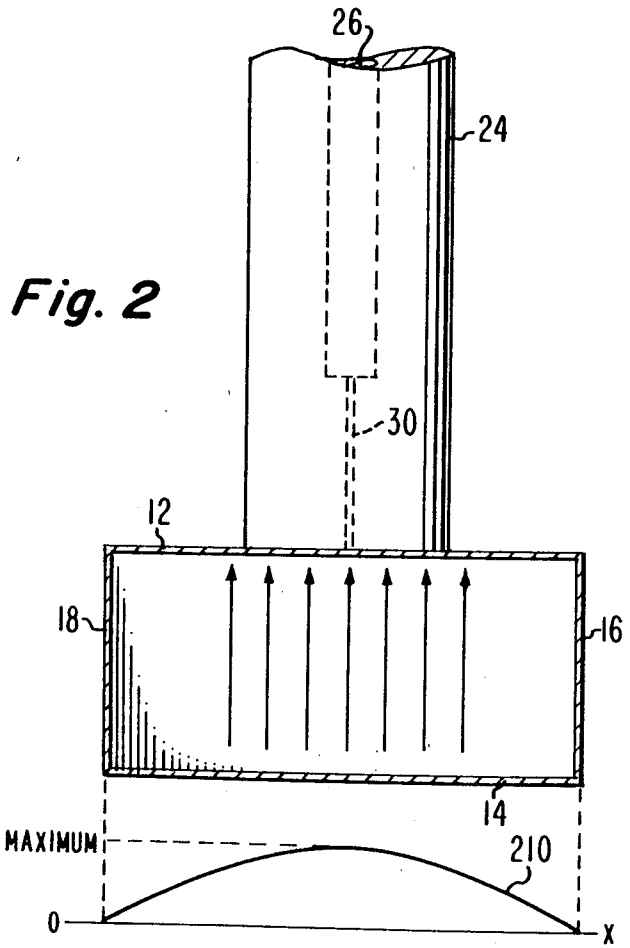

FIG. 2 is a cross-sectional view of the arrangement of FIG. 1 looking in the Z direction at the point indicated by chain lines 2—2. The instantaneous direction of the electric fields in the waveguide is illustrated by a number of vertically oriented arrows, the density of which is indicative of the relative electric field intensity. Plot 210 suggests the intensity distribution of the electric field as a function of lateral position of the waveguide. As known, the electric field intensity adjacent narrow walls 16 and 18 is 0, because the electric field cannot be sustained parallel to a conductive wall.

It should be noted that in the region between aperture 29 and the edge 38 of plate 30 remote from aperture 29, outer conductor 24 and plate 30 may be viewed as forming a pair of waveguides, each waveguide having a semicircular shape established by walls including a curved portion formed by the appropriate portion of outer conductor 24 and a flat portion constituting plate 30. Thus, plate 30 in effect is a common wall between two semicircular waveguides having common axes centered on axis 27 in the common wall. These two semicircular waveguides are most easily visualized by reference to FIG. 4. This view is not inconsistent with considering the region to be a coaxial line with a short-circuit plate.

Figure 3:
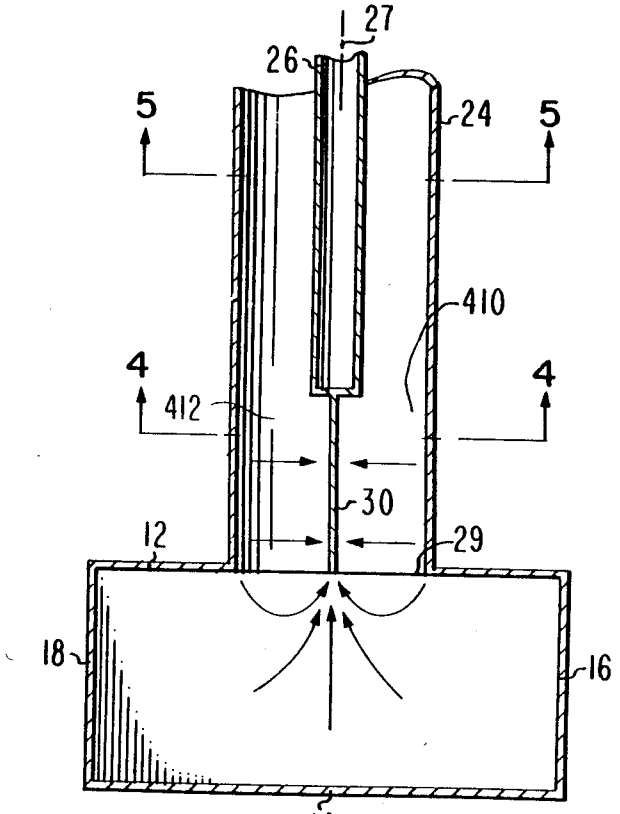
FIGS. 2, 3, 4 and 5 are sections of the arrangement of FIG. 1 illustrating the electric field configuration.

FIG. 3 illustrates a cross-sectional view of adapter 10 looking in the Z direction at a position 3—3 centered on axis 27 of center conductor 26. As in the case of FIG. 2, the electric field intensity and instantaneous direction is illustrated by arrows. As can be seen, the electric field terminates on the edge of conductive plate 30. At positions above aperture 29 (i.e., within the confines of outer-conductor 24) the electric field has instantaneous polarity or direction which is physically opposed in semicircular waveguide portions 410 and 412, since the tips of the arrow (representing either the positive or negative extreme of the electric field) are adjacent common wall 30. The indicated mode for each semicircular waveguide is the $TE_{1,0}$ mode. It should be noted that the semicircular waveguides may be considered to be coupled in parallel for receiving energy from waveguide portion 11.

Figure 4:
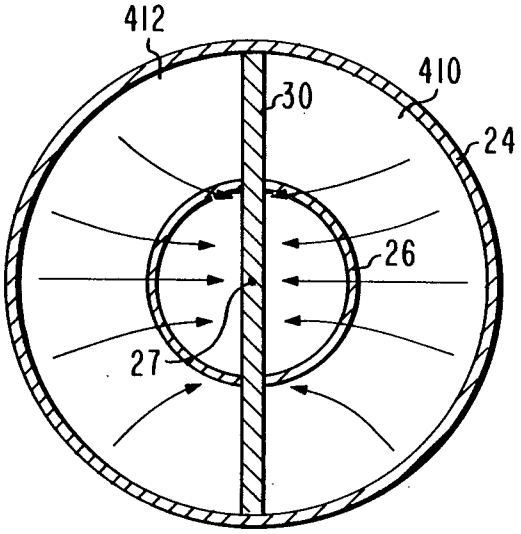

FIG. 4 is a cross-sectional view taken in a plane parallel to the X-Z plane and looking in the Y direction along axis 27. In FIG. 4, the physically opposite directions of the electric field can easily be seen.

Figure 5:
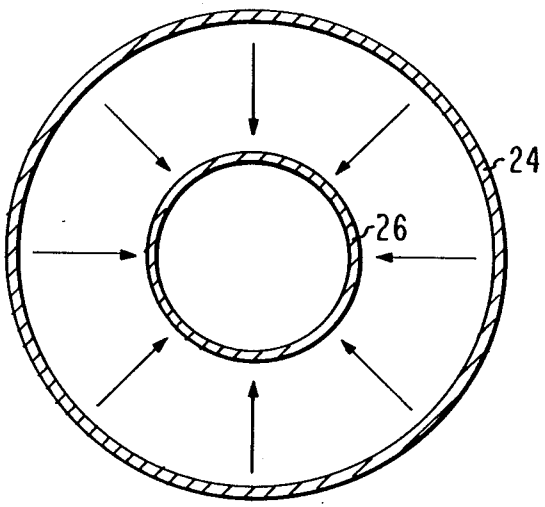

FIG. 5 is a cross-sectional view of the coaxial transmission line 22 in a plane parallel with X-Z plane and taken at a point more than one wavelength from upper edge 38 of conductive plate 30. As before, the electric field is indicated by arrows. It can be seen that the arrows are symmetrically disposed and are typical of the TEM-mode giving no hint of the $TE_{11}$ mode. The $TE_{1,1}$ mode is not generated at the transition, because $TE_{1,1}$ requires that the electric fields in one of the semicircular waveguides (see FIG. 4) be reversed in direction or at least unequal in amplitude with respect to the other. Thus, the undesirable mode is not generated and is therefore not propagated into the coax line.

Figure 6:
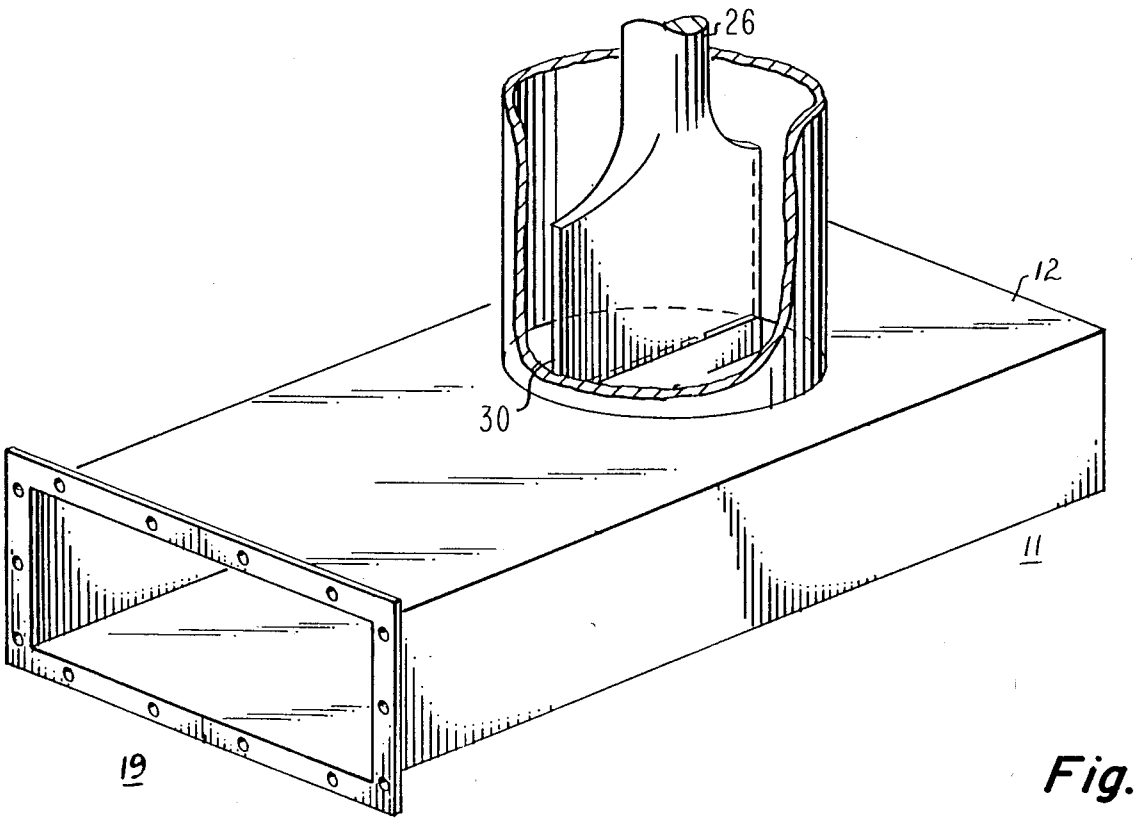
FIG. 6 is a partially cut-away perspective view of a waveguide-to-coax adapter according to the invention illustrating a gradual transition from a flat plate to a cylindrical center conductor.

FIG. 6 illustrates a tapered transition between plate 30 and coaxial center-conductor 26 which aids in impedance control by, in one view, reducing the relative change in impedance per unit length and allowing a more gradual change in impedance from the region of the plate to the region of the coax, or in another view by creating many small reflections at the incremental discontinuity which tend to cancel due to incremental phase differences. That portion of plate 30 adjacent rectangular waveguide 11 is flat and extends straight across outer conductor 24.

Figure 10A:
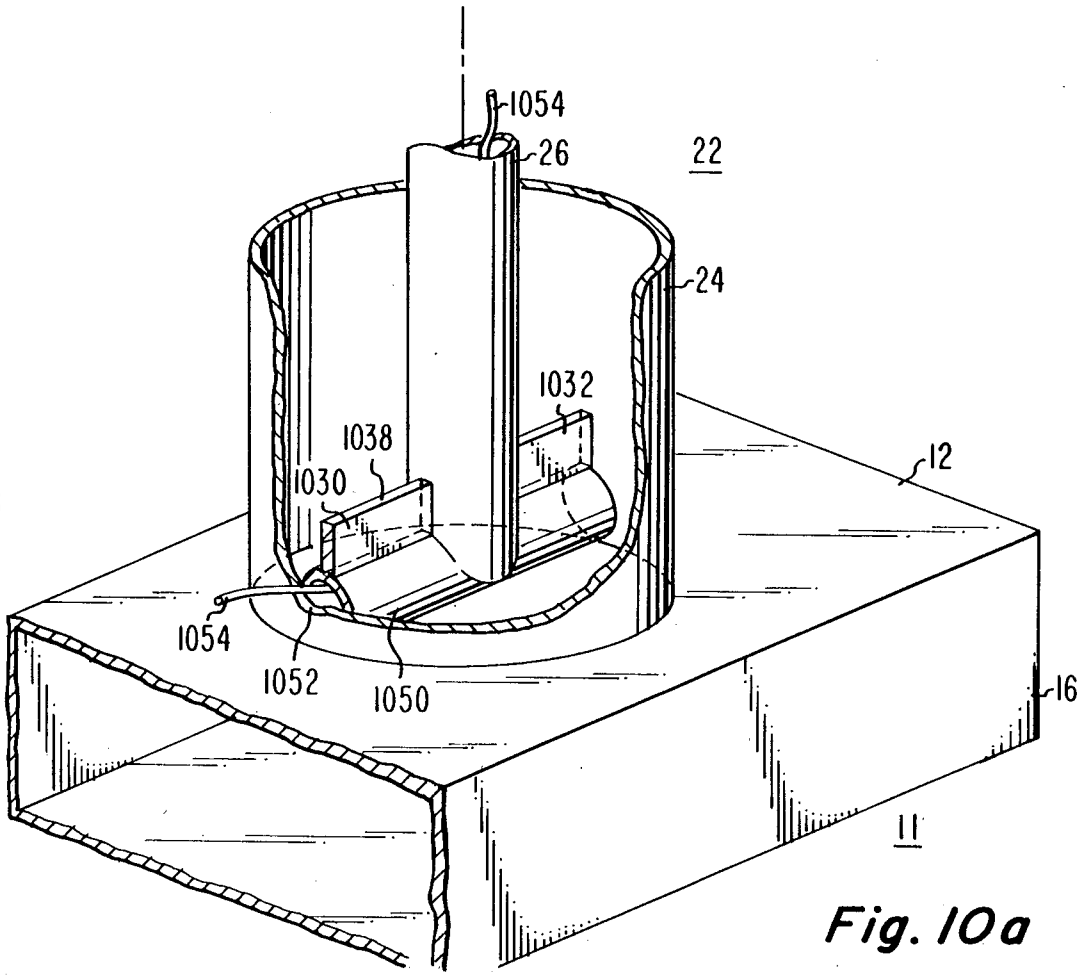
FIGS. 10*a* and 10*b* are partially cut-away perspective view and an ancillary sectional view, respectively, of a waveguide-to-coax adapter according to the invention illustrating use of a crossbar to reduce voltage gradients for improved reliability.
Figure 10B:
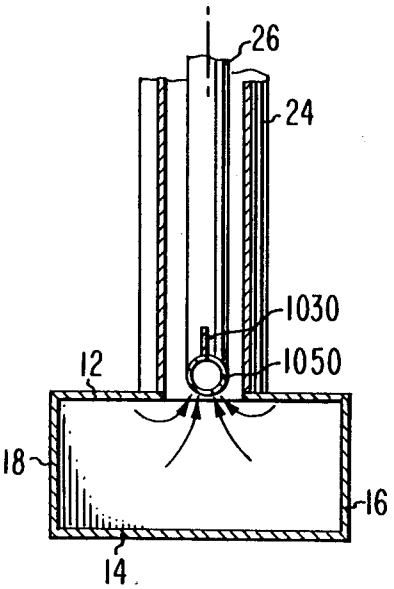

FIGS. 10*a* and 10*b* illustrates an enlarged lower edge for plate 30 which reduces voltage stresses or gradients at the transition for reducing the likelihood of voltage breakdown at high power levels, and which also desirably provides a means for access to the interior of the inner conductor 26 of the coaxial transmission line. In FIG. 10*a*, a hollow conductive cylindrical bar or pipe 1050 extends diametrically across and is mechanically coupled to the interior walls of outer conductor 24. The diameter of bar 1050 is substantially equal to that of inner conductor 26. Inner conductor 26 intersects and is connected to the center of bar 1050. Two flat coplanar conductive plates 1030 and 1032 extend diametrically across outer conductor 24 and form a common wall between the two semicircular waveguides opening into rectangular waveguide 11 and into coax 22.

A circular aperture 1052 (a portion of which is illustrated as having been cut away) in outer conductor 24 provides access to the interior of bar 1050 and to the interior of inner conductor 26. An electrical cable 1054 is illustrated entering aperture 1052 and exiting at the upper end of inner conductor 26 to show that wires for heaters, warning lights, and the like may easily be fed to the inside of the center conductor. FIG. 10*b* is a section taken in a plane orthogonal to the plane of plate 1030 and passing its center, illustrating the electric field structure. By comparison with the section of FIG. 3, the density of the arrows at the location of bar 1050 can be seen to be less than the density of the arrows terminating on the lower edge of plate 30, and the voltage gradient and likelihood of voltage breakdown is therefore lower.

Figure 7:
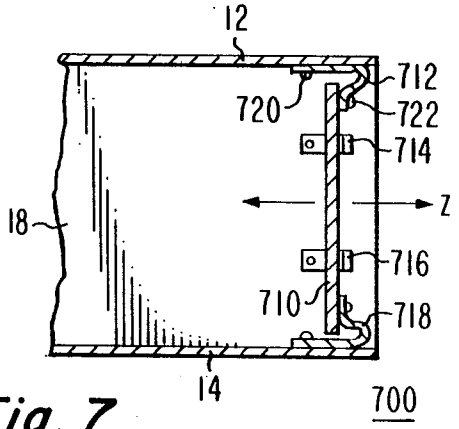
FIG. 7 is a cross-sectional view of an adjustable short-circuit arrangement.

FIG. 7 illustrates in cross-sectional view an adjustable waveguide short-circuit. The short-circuit is located about $\lambda/4$ from the axis 27 within waveguide 11. The short-circuit includes a rectangular conductive plate 710 slightly smaller than the dimensions of the aperture defined by walls 12–18. Contact with the walls is provided by flexible conductive strips such as berillium-copper strips 712–718 fastened to an outer wall at one extremity and fastened to conductive plate 710 at the other extremity, leaving the region of the strip between the extremities available for flexure. For example, strip 712 is fastened to wall 12 by a screw 720 and is fastened to conductive plate 710 by a second screw 722. Flexure of strip 712 is possible as plate 710 is moved in the Z direction. Adjustment of plate 710 (by means not shown) allows fine control of the impedance presented at input port 19.

Figure 9:
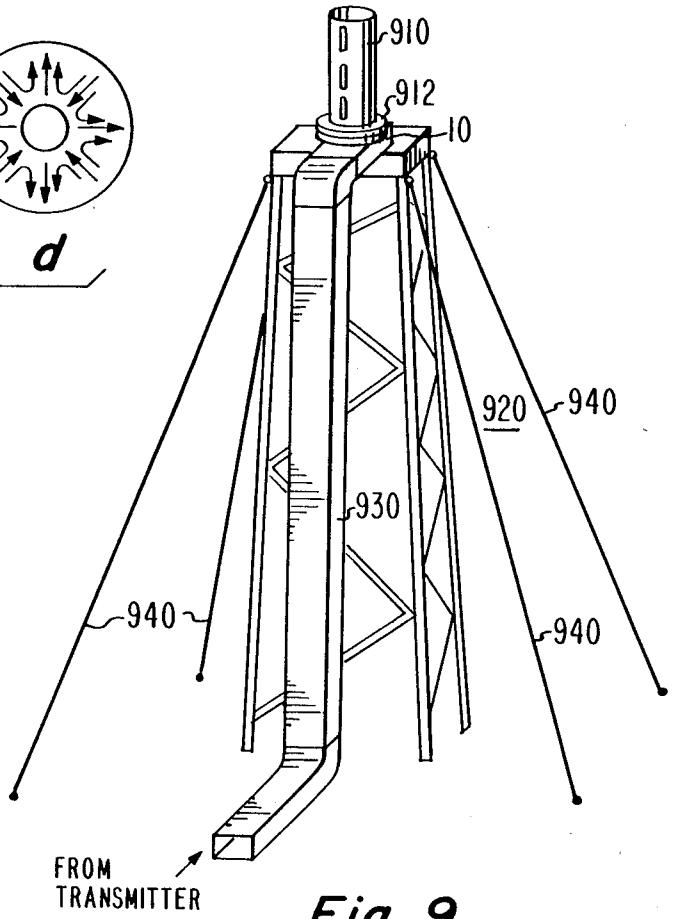
FIG. 9 illustrates an antenna, tower and feed-line structure utilizing a waveguide-to-coaxial line adapter in accordance with the invention.
Figure 8:
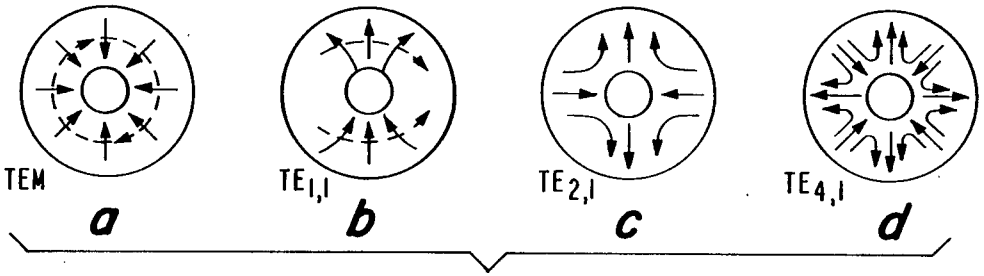
FIG. 8 illustrates various coaxial-line operating modes.

In FIG. 9, a coaxial slotted cylinder antenna 910 is supported at the top of a tower designated generally as 920 by a bolt flange 912 fastened to a corresponding flange on the tower. A waveguide-to coax adapter 10 tending to cancel $TE_{1,1}$ mode couples the coaxial feed of the antenna to a waveguide 930 which in turn is coupled to a transmitter (not shown) at the base of the tower. Windloads on the tower are withstood by the legs of the tower and by the guy wires 940 coupled to ground anchors (not shown). The arrangement of FIG. 9 allows high-power signals to be transmitted to the top of a high tower with low attenuation, and coupled to a large-diameter coax-fed pylon antenna for broadcast therefrom without the radiation pattern perturbations occasioned by propagation in the coaxial transmission line of the antenna of higher-order modes generated by the waveguide-to-coax transition.

Other embodiments of the invention will be apparent to those skilled in the art. For example, the invention is not limited to use with a coax-fed pylon antenna. Any coax-fed antenna may benefit, including a monopole. The waveguide run up the tower may be accomplished by means of circular rather than rectangular waveguide, in which case a circular-to-rectangular waveguide adapter is coupled between the output end of the circular waveguide and the input end of a rectangular-waveguide-to-coax adapter such as that described. The signal input end of adapter 10 may be the coax and the output may be the waveguide, if desired. Furthermore, the tapered adapter illustrated in FIG. 6 may be used in conjunction with the bar illustrated in FIG. 10.

What is claimed is:

1. A rectangular-waveguide-to-coaxial-transmission-line coupler, comprising:

a section of rectangular waveguide having mutually parallel pairs of wide walls and narrow walls, said wide walls being bisected by a plane of symmetry parallel with said narrow walls, one of said wide walls defining a circular aperture having a diameter and also having a center lying in said plane of symmetry;

short-circuit terminating means coupled to said section of rectangular waveguide at a distance from said center of said aperture;

cylindrical outer-conductor means having an axis and also having a second, outer, diameter greater than said diameter of said aperture, said cylindrical outer-conductor means intersecting said one of said wide walls with said axis lying in said plane of symmetry and intersecting said center of said aperture whereby said aperture couples the interior of said rectangular waveguide with the interior of said cylindrical outer-conductor means;

a flat conductive plate extending diametrically across said cylindrical outer-conductor means and coupled to the walls thereof at diametrically opposed locations, the plane of said flat conductive plate lying in said plane of symmetry, said plate being located so that edge of said plate closest to said aperture coincides with the plane of said aperture; and a cylindrical center-conductor coaxial with said cylindrical outer-conductor means and coupled to that portion of said flat conductive plate remote from said aperture, said center-conductor terminating within said cylindrical outer-conductor means.

2. A coupler according to claim 1 wherein said flat conductive plate is coupled to said cylindrical center-conductor by a transition which gradually tapers in shape from flat to cylindrical.

3. A coupler according to claim 1 wherein the position of said short-circuit terminating means is adjustable.

4. A coupler according to claim 1 wherein the position of said short-circuit terminating means is one quarter-wavelength from said center of said circular aperture.

5. A rectangular-waveguide-to-coaxial transmission-line coupler, comprising:

a section of rectangular waveguide having mutually parallel pairs of wide walls and narrow walls, said wide walls being bisected by a plane of symmetry parallel with said narrow walls, one of said wide walls defining a circular aperture having a diameter and also having a center lying in said plane of symmetry;

short-circuit terminating means coupled to said section of rectangular waveguide at a distance from said center of said aperture;

cylindrical outer-conductor means having an axis and also having a second, outer, diameter greater than said diameter of said aperture, said cylindrical outer-conductor means intersecting said one of said wide walls with said axis lying in said plane of symmetry and intersecting said center of said aperture whereby said aperture couples the interior of said rectangular waveguide with the interior of said cylindrical outer-conductor means;

a conductive bar having an axis and extending diametrically across said cylindrical outer-conductor means and coupled to the walls thereof at diametrically opposed locations, said axis lying in said plane of symmetry and located so that portion of said bar nearest said rectangular waveguide substantially coincides with the plane of said aperture; and a cylindrical center-conductor coaxial with said cylindrical outer-conductor means coupled to and terminating at said bar.

6. A coupler according to claim 5 further comprising first and second coplanar flat plates lying in said plane of symmetry and connected to said outer conductor, said bar and said center conductor.

* * * * *